US008253644B2

(12) United States Patent
Hnatiw

(10) Patent No.: US 8,253,644 B2
(45) Date of Patent: Aug. 28, 2012

(54) CONTROL OF PASSIVE INTERMODULATION ON AIRCRAFTS

(75) Inventor: Alan Julian Paul Hnatiw, Stittsville (CA)

(73) Assignee: CMC Electronics Inc., Montreal (CA)

( * ) Notice: Subject to any disclaimer, the term of this patent is extended or adjusted under 35 U.S.C. 154(b) by 439 days.

(21) Appl. No.: 12/550,636

(22) Filed: Aug. 31, 2009

(65) Prior Publication Data

US 2011/0050530 A1 Mar. 3, 2011

(51) Int. Cl.
*H01Q 1/52* (2006.01)
*H01Q 1/28* (2006.01)

(52) U.S. Cl. ..... 343/841; 343/705; 343/708; 244/158 A; 244/121; 244/1 A

(58) Field of Classification Search ..... 343/841, 343/705, 708; 277/228, 312, 316; 244/158 A, 244/117 A, 121, 163
See application file for complete search history.

(56) References Cited

U.S. PATENT DOCUMENTS 5,304,962 A 4/1994 Bobadilla et al.
5,458,162 A 10/1995 Sinha
5,494,755 A 2/1996 McCloskey
5,598,989 A 2/1997 Ross et al.
5,626,314 A 5/1997 Reynolds et al.
5,702,111 A * 12/1997 Smith ..... 277/650
5,885,906 A 3/1999 Reynolds et al.
6,454,267 B1 * 9/2002 Gaines et al. ..... 277/312
7,397,429 B2 * 7/2008 Crain et al. ..... 343/700 MS
8,026,857 B2 * 9/2011 Bommer ..... 343/708
2003/0013809 A1 * 1/2003 Coles et al. ..... 525/100
2008/0191423 A1 * 8/2008 Cohen ..... 277/316

OTHER PUBLICATIONS

D. Wolk et al., "Surface Treatment and Coating for the Reduction of Multipactor and Passive Intermodulation (PIM) Effects in RF Components", 4th International Workshop on Multipactor, Corona and Passive Intermodulation in Space RF Hardware, Sep. 2003.
F. Suarez et al., "A Titanium Nitride coating tested in Passive Intermodulation", 4th International Workshop on Multipactor, Corona and Passive Intermodulation in Space RF Hardware, Sep. 2003.

* cited by examiner

*Primary Examiner* — Hoang V Nguyen
(74) *Attorney, Agent, or Firm* — DLA Piper LLP US

(57) ABSTRACT

There is described a Passive Intermodulation (PIM) shield for use with an aircraft for reducing PIM sources, the PIM shield comprising: a conductive material adapted to be placed between an antenna and a fuselage of the aircraft for preventing undesired Radio Frequency (RF) signals resulting from a combination of RF signals transmitted from and to the antenna and generated by non-linear junctions or material between the antenna and the fuselage of the aircraft, the conductive material having a thickness based on an RF skin-depth related to an operating frequency of the antenna. There is described a method for determining an operating frequency of an antenna, determining an RF skin-depth related to the operating frequency of the antenna, and providing the PIM shield.

21 Claims, 10 Drawing Sheets

7th order product in the Rx band can "wipe out" a receive channel if it is at the same frequency as the assigned receive channel.

CONTROL OF PASSIVE INTERMODULATION ON AIRCRAFTS

CROSS-REFERENCE TO RELATED APPLICATIONS

This is the first application filed for the present invention.

TECHNICAL FIELD

The invention relates to the field of Passive Intermodulation (PIM) that occurs on aircrafts.

BACKGROUND

Traditional antennae used on the exterior of an aircraft can simultaneously receive and transmit a plurality of RF signals. These traditional antennae and the aircraft on which they are installed are made of materials such as stainless steel, aluminum or other metallic materials. When an antenna receives or transmits two or more RF signals, an undesired mixed RF signal, which is a combination of RF signals sent to and from the antenna, is generated between the antenna and the aircraft. PIM occurs when the undesired RF signal's carrier falls within an antenna receiving RF band, and the undesired RF signal interferes with RF signals that are regularly sent to the antenna.

Therefore, there is a need to provide reduction of PIM when an aircraft is in flight condition.

SUMMARY

In accordance with a first broad aspect, there is provided a Passive Intermodulation (PIM) shield for use with an aircraft for reducing PIM sources, the PIM shield comprising: a conductive material adapted to be placed between an antenna and a fuselage of the aircraft for preventing undesired Radio Frequency (RF) signals resulting from a combination of RF signals transmitted from and to the antenna and generated by non-linear junctions or materials between the antenna and the fuselage of the aircraft, the conductive material having a thickness based on an RF skin-depth related to the operating frequency of the antenna.

In accordance with a second broad aspect, there is provided in a method for reducing Passive Intermodulation (PIM) on an aircraft, the method comprising: determining an operating frequency of an antenna; determining an RF skin-depth related to the operating frequency of the antenna; providing a conductive material between the antenna and a fuselage of the aircraft for preventing undesired Radio Frequency (RF) signals resulting from a combination of RF signals transmitted from the antenna and generated by non-linear junctions or material between the antenna and the fuselage of the aircraft, the conductive material having a thickness based on the RF skin-depth.

BRIEF DESCRIPTION OF THE DRAWINGS

Further features and advantages of the present invention will become apparent from the following detailed description in conjunction with the appended drawings, in which.

It will be noted that throughout the appended drawings, like features are identified by like reference numerals.

DETAILED DESCRIPTION

PIM occurs, for example, when two or more signals are mixed through non-linear elements to create a sum of difference frequencies. PIM can be represented by a mathematical relationship, which stems from harmonic where a first carrier (f1) and a second carrier (f2) of a signal are mixed by a PIM source. For example, the 1st order is defined by f1−f2 and f2−f1, the 3rd order 2*f1−f2 and 2*f2−f1, the 5th order 3*f1−2*f2 and 3*f2−2*f1, the 7th order 4*f1−3*f2 and 4*f2−3*f1, the 9th order 5*f1−4*f2 and 5*f2−4*f1, etc.

Figure 1A:
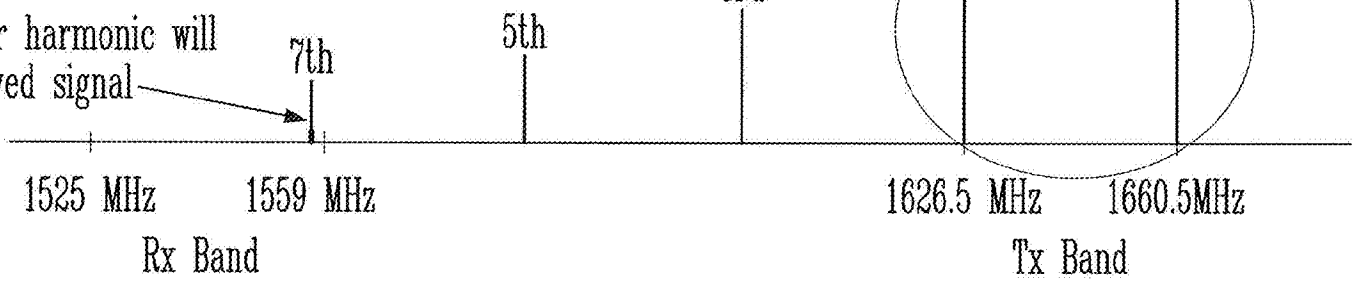
FIGS. 1A and 1B are exemplary representations of PIM generated signals in accordance with an embodiment.
Figure 1B:
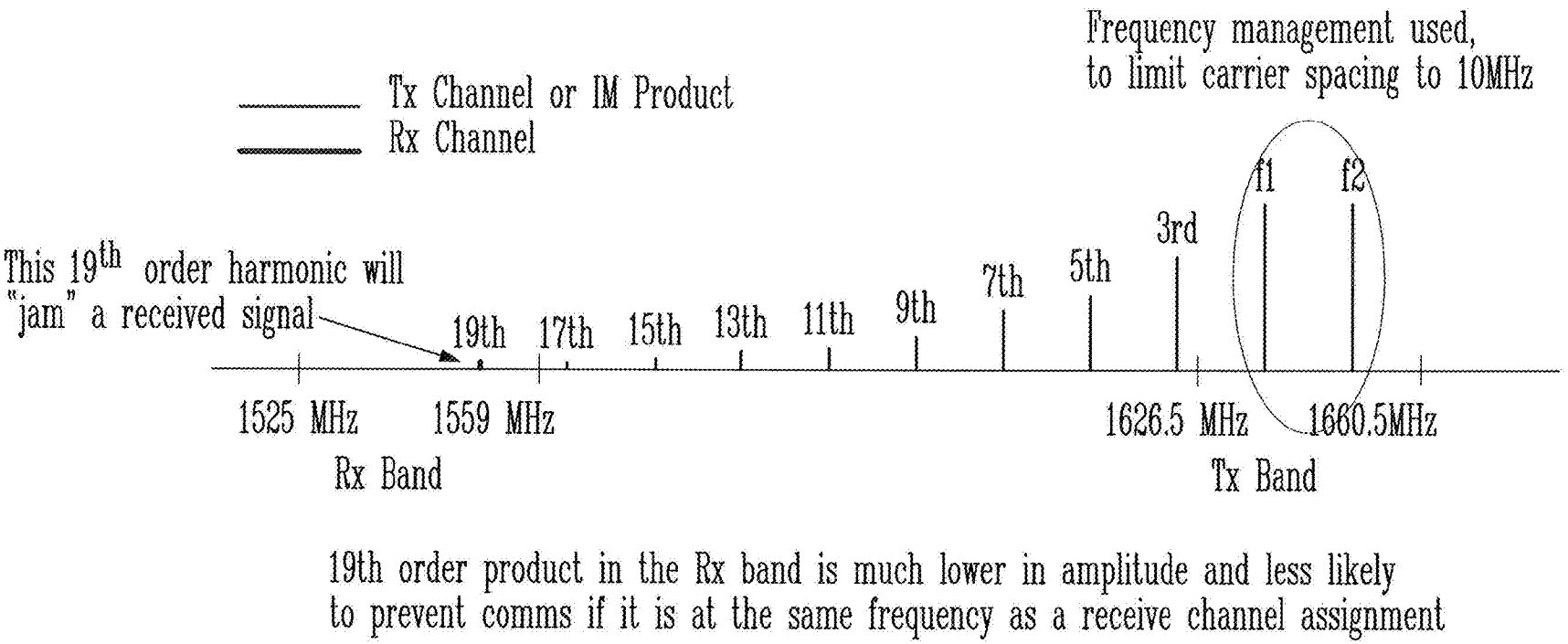

Reference is now made to FIGS. 1A and 1B, which are examples of representations of PIM signals in accordance with an embodiment. In FIGS. 1A and 1B the power or size of the order decreases as the PIM order of harmonic increases. In FIG. 1A there is no frequency management and any carrier spacing is possible. In FIG. 1B, frequency management is used to limit the spacing of carriers. When there is no frequency management, a higher order harmonic will most likely affect a received signal. In the case where there is a carrier management, the power of the harmonic that affects a received signal is lower. However, PIM generation still affects any received signal. For example, as PIM orders fall within an allocated bandwidth from a service provider, PIM limits the number of users that can simultaneously access the system on an allocated bandwidth.

Various factors may cause generation of PIM, and one of a particular interest is metal contact between an antenna and a fuselage of an aircraft. In the case of metal contact, the junctions between the antenna and the aircraft may be non-linear, and thus cause PIM. PIM also occurs when RF currents pass through certain materials/structures and can also be based on corrosion, ferromagnetic materials and low pressure contacts. In the case of avionic antennas, stainless steel hardware and aluminum are the default materials of product construction and thus their contact may produce lap joints that can cause PIM. Therefore, it is desirable to prevent PIM generation in the region defined by the junctions between the antenna and the fuselage of an aircraft, and to prevent penetration of such RF signals in the aircraft. PIM occurs when the undesired RF signal's carrier falls within an antenna receiving RF band, and thus the undesired RF signal interferes with RF signals that are regularly sent to the antenna. The use of a PIM shield in the vicinity of the junctions between the antenna and the fuselage of the aircraft can prevent undesired signals from penetrating the aircraft or from being generated by the same described junctions.

Figure 2:
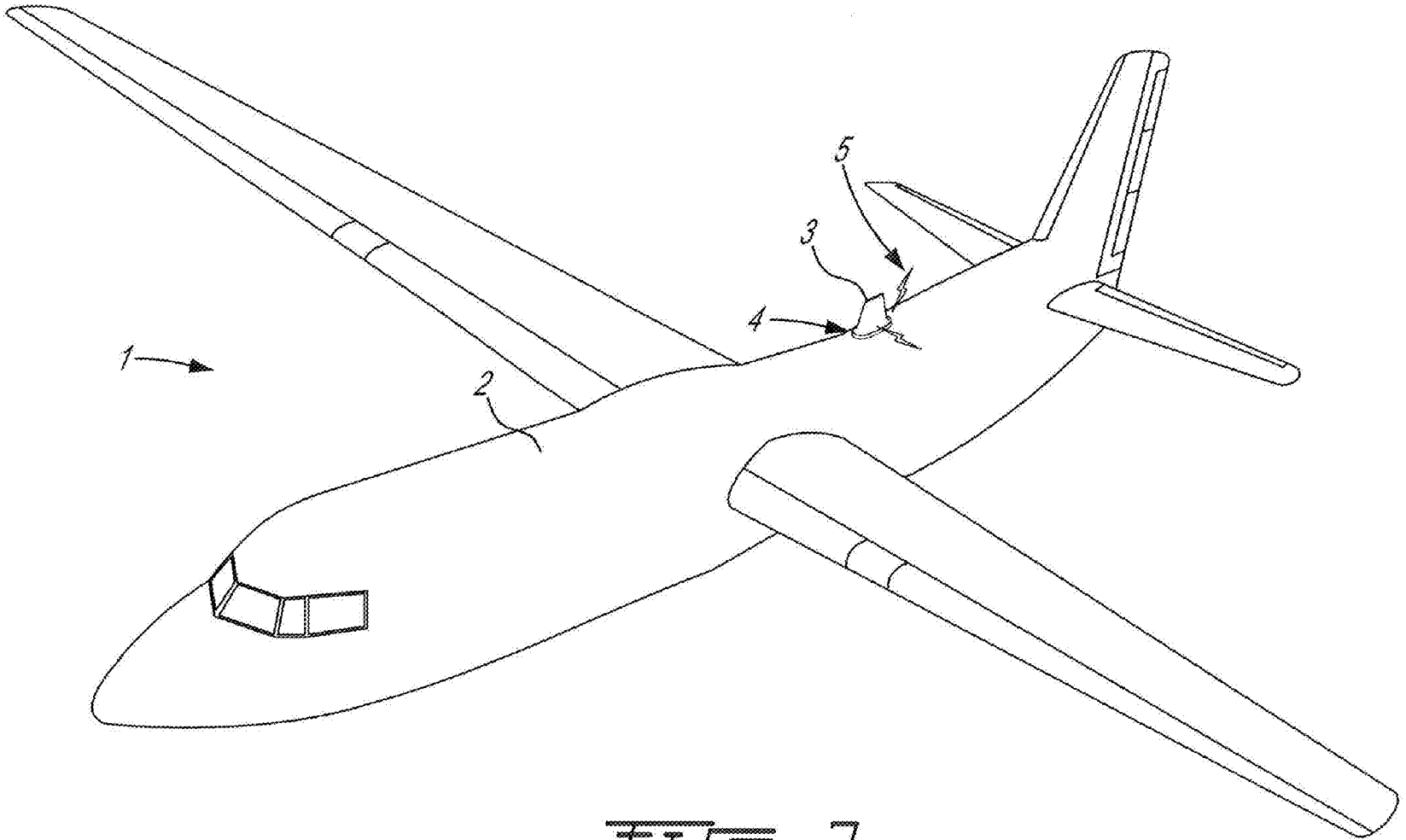
FIG. 2 is a planar view of an aircraft having an antenna in accordance with an embodiment.

Reference is now made to FIG. 2, which is a planar view of an aircraft 1 having an antenna 3 affixed to a fuselage 2 of the aircraft 1 in accordance with an embodiment. As described above, PIM 5 can be generated on the aircraft 1 by non-linear elements such as at the junctions 4 of the antenna and the fuselage of the aircraft 1.

The aircraft 1 can be any type of machine or device, such as an airplane, helicopter, glider, drone or dirigible capable of atmospheric flight. Atmospheric conditions provide some particularities related to gas compositions that are not present in outer space or in water. In addition, some characteristics that make atmospheric conditions different from water and outer space environmental conditions and that can affect the properties of the conductive material used in the composition of the aircraft 1 are the pressures related to altitude or atmospheric phenomena.

The antenna 3 can be any type of antenna that allows a range of electromagnetic waves to be emitted and transmitted with a frequency or wavelength suitable for utilization in radio communications, and based on various telecommunication protocols and frequency bands. Thus, the antenna 3 can be an antenna dedicated to transmissions based on, for example, UHF, VHF, HF, etc. In the embodiment illustrated in FIG. 2, at least one antenna 3 is combined with the aircraft 1 to transmit and receive RF signals. In one embodiment, the antenna 3 is affixed to the fuselage 2 of the aircraft 1 using screws 14, but the skilled addressee will understand that any type of means to affix the antenna to the aircraft 1 can be used, such as rivets, pins or other equivalent retaining means.

Reference is now made to FIGS. 3A-3F, which are partial views of FIG. 2 having a PIM shield in accordance with an embodiment. According to FIGS. 3A-3F, the aircraft 1 comprises the PIM shield to cover the junctions 4 of the antenna 3 and the fuselage 2 of the aircraft 1. The PIM shield 6 is in use with the antenna 3 and the fuselage 2 of the aircraft 1 to reduce PIM sources. Other factors, as it will be discussed below, may provide PIM reduction on the aircraft 1. With respect to conductive material properties, the properties which may provide PIM reduction can be any one of the level of density and/or thickness of the conductive material, use of high loss RF materials that absorb signals, the resistance or susceptibility to atmospheric conditions, etc. Other factors such as the combination of different layers of conductive materials together to form the conductive material may also be a factor in the capabilities of the PIM shield 6 to reduce PIM.

In one embodiment, the PIM shield 6 is made of the same conductive material as the fuselage 2 or the antenna 3 in order to absorb undesired RF signals, prevent those signals from penetrating the aircraft, and provide a continuous conductive surface. In another embodiment, the conductive material can be different from the conductive material in which the aircraft is made of. In yet another embodiment the conductive material can be any one of: silver, copper, gold, aluminum, brass, bronze, mercury, graphite, etc. In another embodiment, the PIM shield 6 can be a combination of two or more of the above listed conductive materials.

Figure 3A:
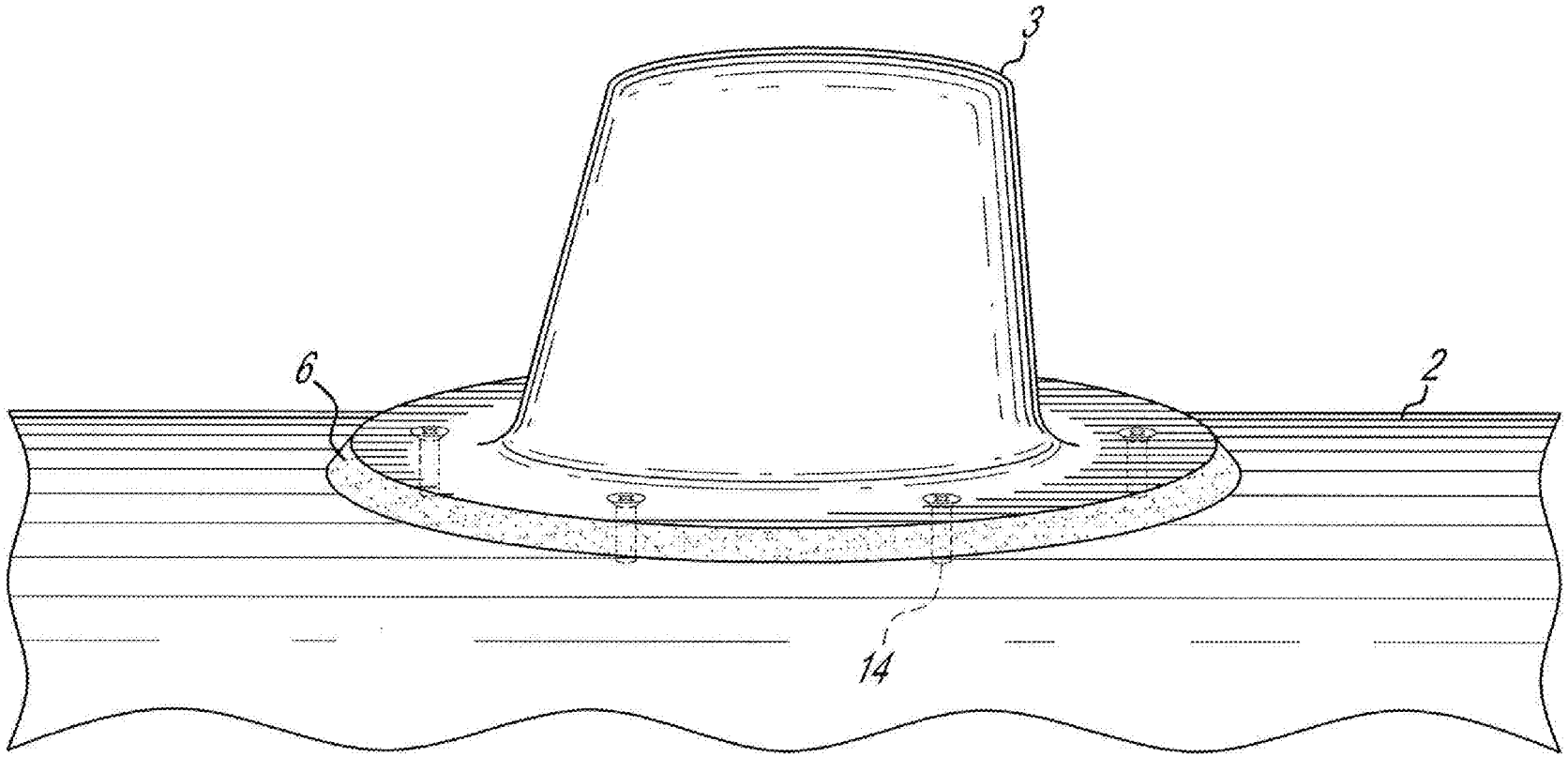
FIGS. 3A-3F are partial views of the aircraft of FIG. 2 having a PIM shield in accordance with an embodiment.

In one embodiment, the PIM shield 6 can be added or installed in various ways, as it will be described below. In the embodiment of FIG. 3A, the PIM shield 6 is provided between the antenna 3 and the fuselage 2 of the aircraft 1 by adding a solid unique piece of continuous conductive material. The PIM shield 6 may be molded and adapted to the screws or the means used to affix the antenna 3 to the fuselage 2 of the aircraft 1 to prevent passage of air between the antenna 3 and the fuselage 2 of the aircraft 1, and thus allow PIM reduction on the aircraft 1.

Figure 3B:
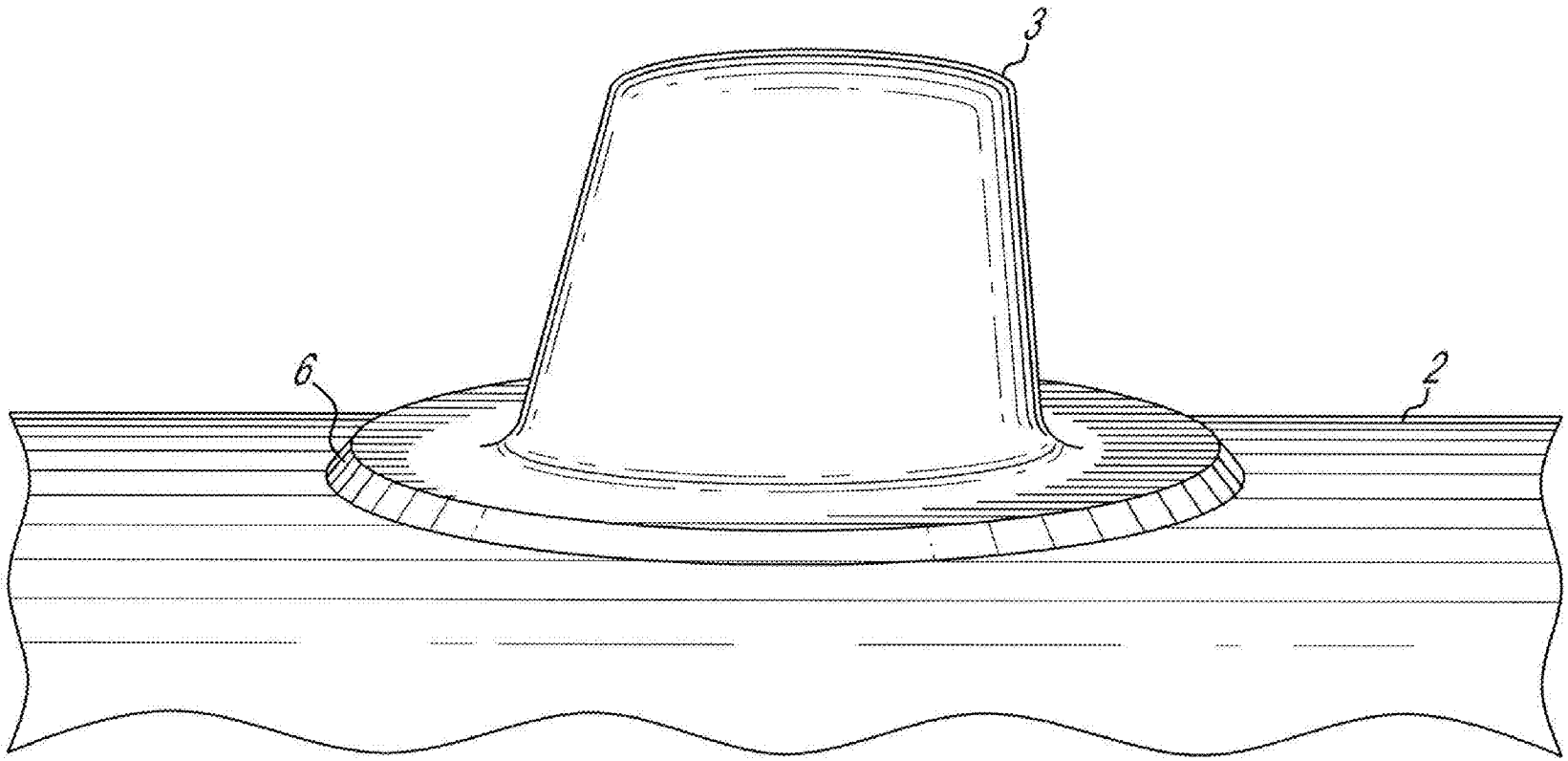

In the embodiment of FIG. 3B, the PIM shield 6 is combined to a structure of the antenna 3. Thus the PIM shield 6 can be manufactured in a single piece with the antenna 3 to provide a smooth continuous surface between the antenna and the fuselage of the aircraft 1, and to minimize PIM due to the non-linear junction between the antenna and the fuselage of the aircraft 1, when the aircraft 1 is exposed to atmospheric conditions. In this embodiment, the material of the PIM shield 6 can be the same as the material of the antenna 3 and the fuselage 2 of the aircraft 1. The combination of material can then reduce PIM. Alternatively, the conductive material of the PIM shield 6 can be different from the material of the fuselage and the antenna, and PIM can be reduced at a junction between the antenna 3 and the PIM shield 6 and at a junction between the PIM shield 6 and the PIM shield 6 and the fuselage 2 of the aircraft 1.

Figure 3C:
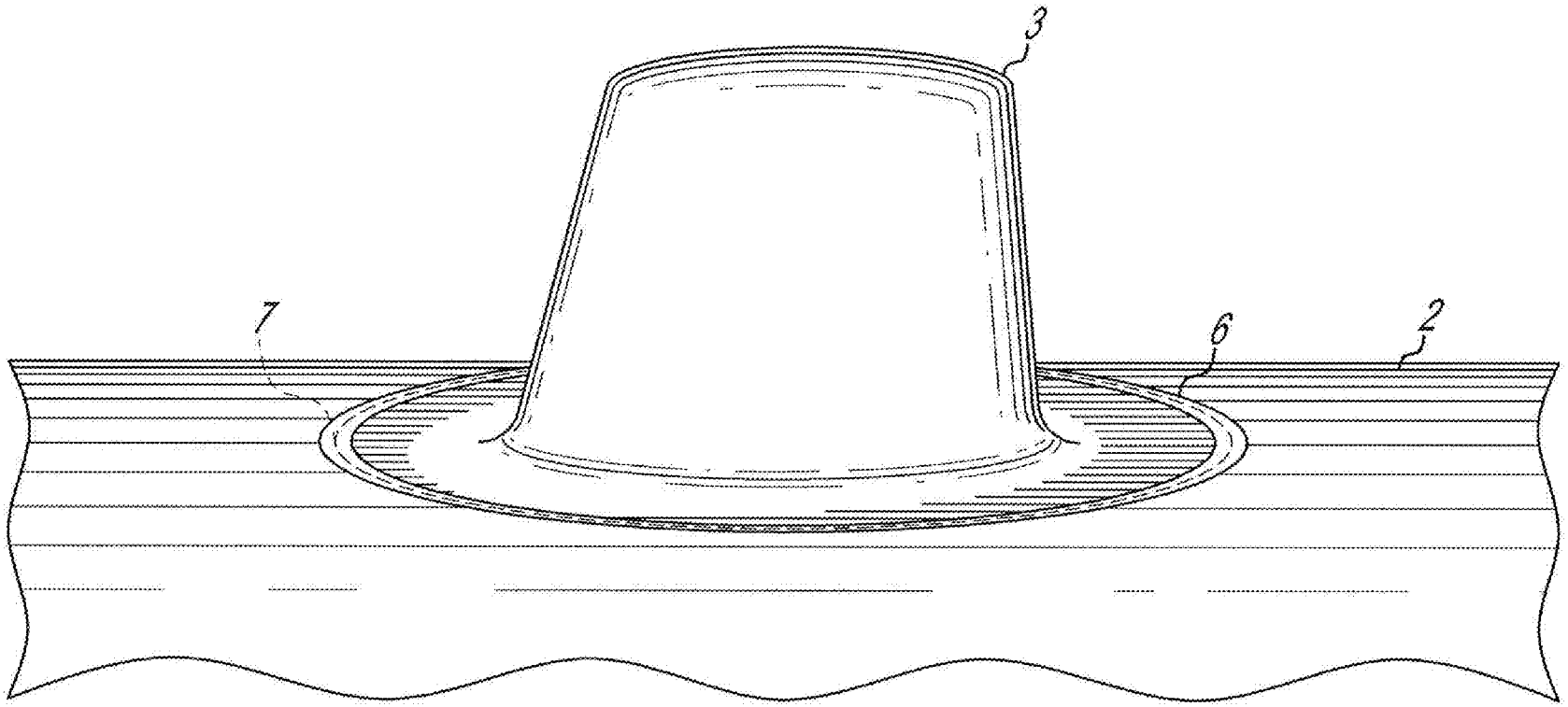

Referring now to FIG. 3C, the conductive material of the PIM shield 6 can be a thin continuous sheet of material to be provided on a junction, which is represented by doted line 7, between the antenna 3 and the fuselage 2 of the aircraft 1. Consequently, the PIM shield 6 can then be used as a tape to cover the junction 7.

Figure 3D:
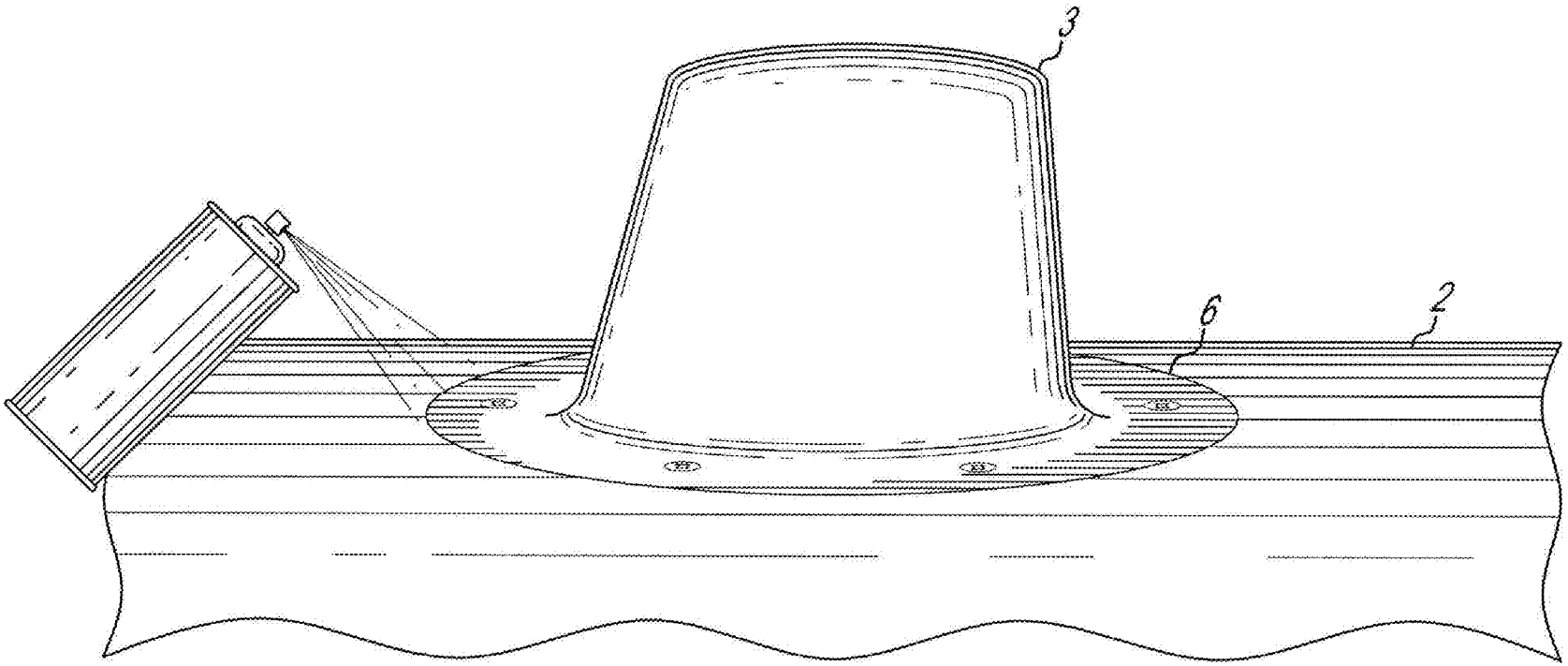

In the embodiment of FIG. 3D, the conductive material of the PIM shield 6 can be a coating in liquid form that is sprayed on a region between the fuselage 2 and the antenna 3. In this embodiment, the conductive material is sprayed on a region at the junction between the antenna 3 and the fuselage 2 of the aircraft 1 in a manner to form a solid PIM shield 6. In this embodiment, the sprayed conductive material of the PIM shield 6 is provided on a region between the fuselage 2 and the antenna 3 to form a smooth conductive surface.

Figure 3E:
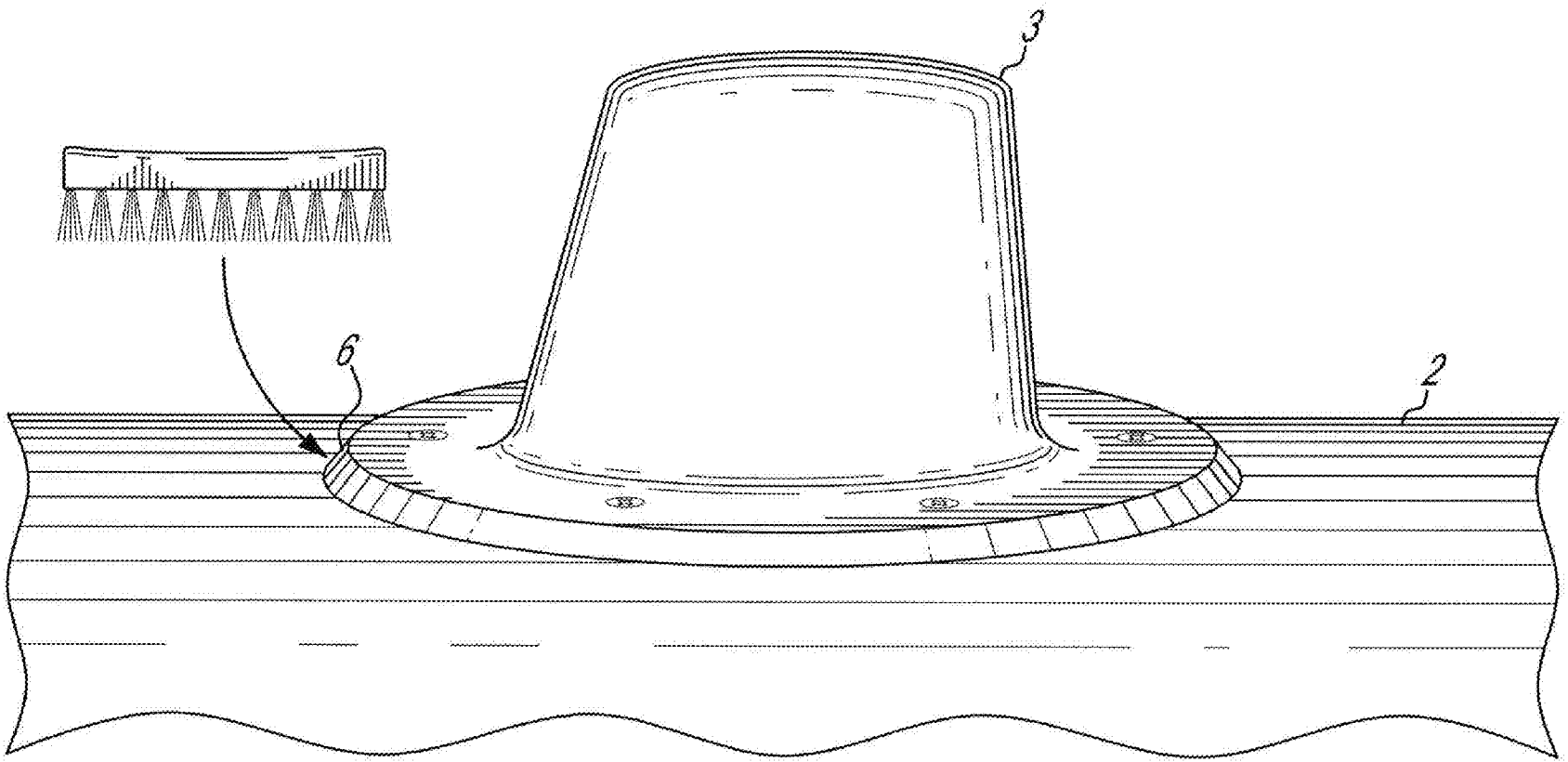

Alternatively at FIG. 3E, the conductive material of the PIM shield 6 is brushed on the region between the fuselage 2 and the antenna 3 to form a smooth conductive surface. This then provides a smooth conductive surface for the PIM shield 6 that is free from irregularities, roughness, or projections.

Figure 3F:
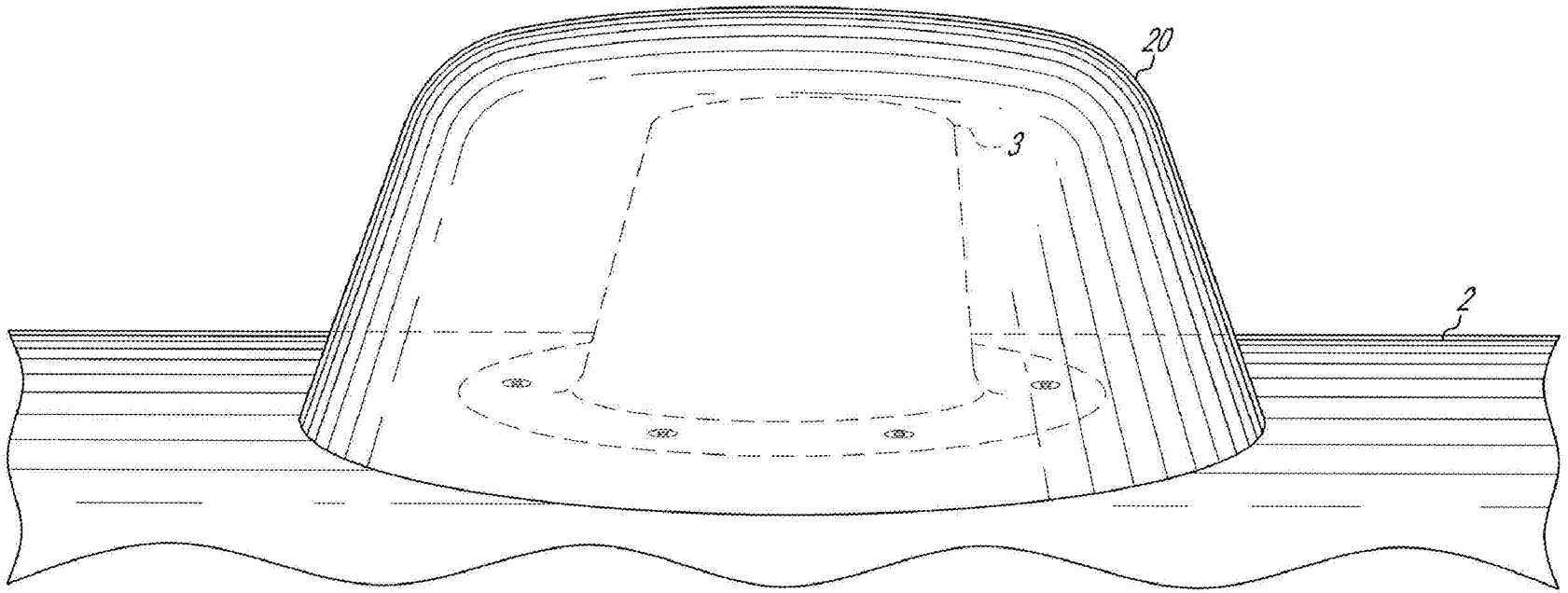

In the embodiment of FIG. 3F, the PIM shield 20 is a cover made in the same conductive material as described above for the PIM shield 6. The PIM shield 20 entirely covers the antenna 3 and is taped or attached to the fuselage 2 of the aircraft.

In FIGS. 3A-3F, the installed conductive material of the PIM shield 6 then absorbs undesired RF signals. This allows non-linear junctions 4 between the antenna and the fuselage of the aircraft to be covered in order to prevent generation of PIM from those junctions, and penetration of undesired RF signals.

In one embodiment, the PIM shield comprises at least one skin-depth, which prevents the penetration of generation of undesired RE signals, where the skin-depth δ for a good conductor is defined as:

$$\delta = \sqrt{\frac{2}{2\pi f \sigma \mu}}$$

where:

f=RF frequency

σ=the conductivity

μ=magnetic permeability of the conductor

The PIM shield has a thickness based on the RF skin-depth. The conductive coating of the PIM shield 6 reduces sources of PIM and improves the overall signal to noise ratio of the antenna. In another embodiment, where the PIM shield 6 is added, combined, sprayed or brushed between the fuselage of the aircraft 1 and the antenna, the thickness can be a value determined by the RF skin-depth. As an example, the coating of the PIM shield 6 is thicker than the RF skin-depth, which can be dependent on the operating frequency. For example, at a frequency of 1.6 GHz (L-Band) the skin depth for aluminum is approximately 2.1 um.

The weight of the PIM shield 6 may also be a factor that can reduce the generation of PIM. The weight is considered to be a factor.

Figure 4:
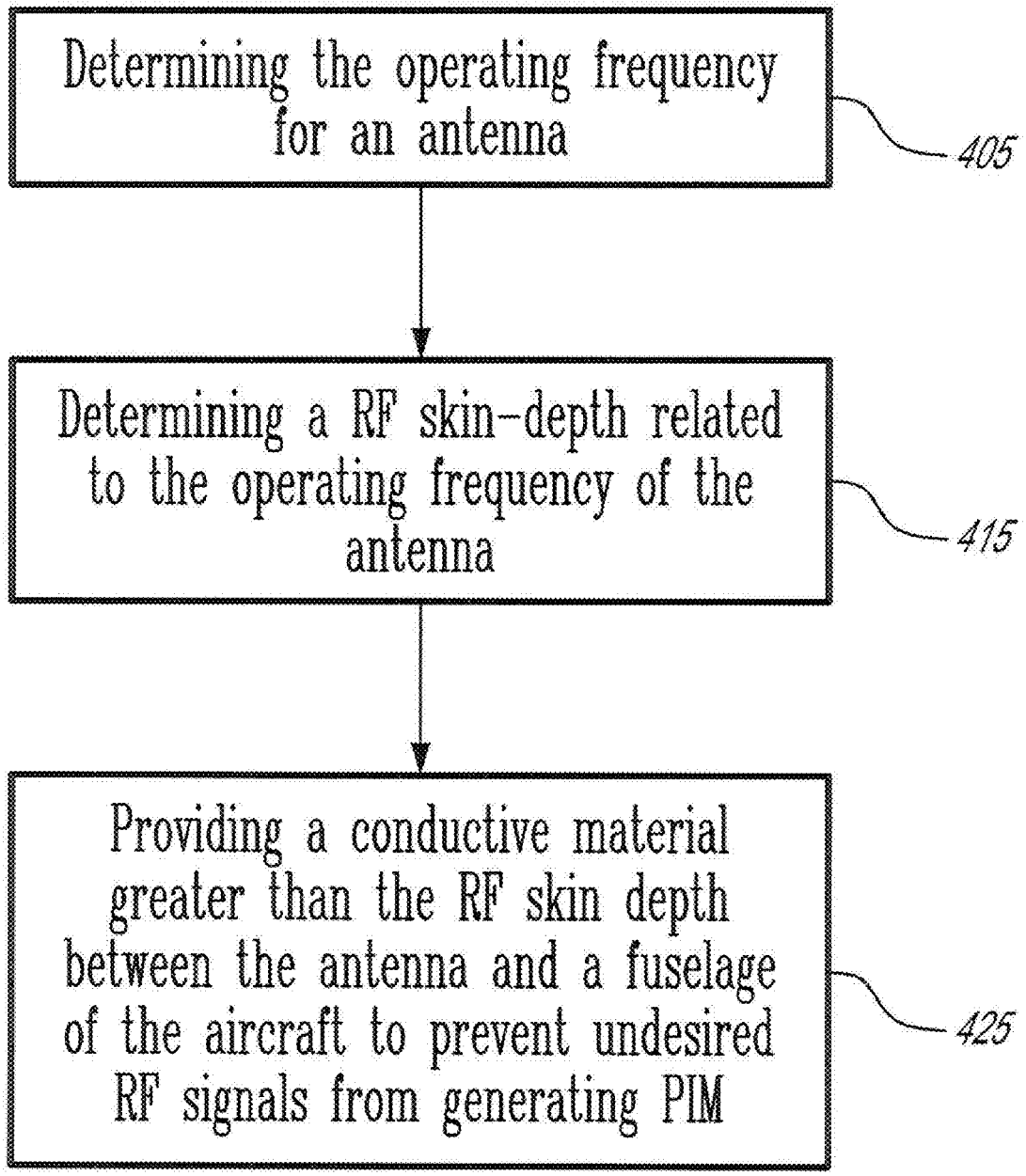
FIG. 4 is a flow chart of a method to provide a PIM shield in accordance with an embodiment.

Reference is now made to FIG. 4, which is a flow chart of a method for providing the PIM shield between an antenna and the fuselage of the aircraft in accordance with an embodiment.

At 405, an operating frequency of an antenna is determined. The operating frequency can vary from a range of from a few MHz to tens of GHz.

At 415, an RF skin-depth related to the operating frequency of the antenna is determined. The RF skin depth allows determining the appropriate coating thickness of the PIM shield to be provided.

At 425, the PIM shield 6 is installed between the antenna 3 and the fuselage 2 of the aircraft 1. The PIM shield then absorbs undesired RF signals resulting from a combination of RF signals transmitted from and to the antenna 3 and generated by non-linear junctions between the antenna 3 and the fuselage 2 of the aircraft 1.

As stated above, the PIM shield can be installed and provided in various ways such as part of a structure of the antenna, sprayed on the conductive material at a region between the fuselage and the antenna, brushed at the region between the fuselage and the antenna, provided as a thin continuous sheet of conductive material, etc.

The embodiments described above are intended to be exemplary only. The scope of the invention is therefore intended to be limited solely by the scope of the appended claims.

The invention claimed is:

1. A Passive Intermodulation (PIM) shield for use with an aircraft for reducing PIM sources, the PIM shield comprising:

a conductive material adapted to be placed between an antenna and a fuselage of the aircraft for preventing undesired Radio Frequency (RF) signals resulting from a combination of RF signals transmitted from and to the antenna and generated by non-linear junctions or material between the antenna and the fuselage of the aircraft, the conductive material having a thickness based on an RF skin-depth related to an operating frequency of the antenna.

2. The PIM shield of claim 1, wherein the conductive material is adapted to absorb undesired RF signals.

3. The PIM shield of claim 1, wherein the conductive material has a smooth PIM free surface.

4. The PIM shield of claim 1, wherein the conductive material has a thickness greater than the RF skin-depth.

5. The PIM shield of claim 1, wherein the conductive material is part of a structure of the antenna.

6. The PIM shield of claim 1, wherein the conductive material is a coating in liquid form.

7. The PIM shield of claim 1, wherein the conductive material is a thin continuous sheet of material.

8. The PIM shield of claim 7, wherein the conductive material is a combination of at least two conductive materials.

9. The PIM shield of claim 7, wherein the conductive material is a high loss RF material that absorbs signals.

10. The PIM shield of claim 7, wherein the conductive material is any of silver, copper, gold, aluminum, brass, bronze, mercury and graphite as the conductive material.

11. A method for reducing Passive Intermodulation (PIM) on an aircraft, the method comprising:

determining an operating frequency of an antenna;

determining a Radio Frequency (RF) skin-depth related to the operating frequency of the antenna;

providing a PIM shield between the antenna and a fuselage of the aircraft for preventing undesired RF signals resulting from a combination of RF signals transmitted from and to the antenna and generated by non-linear junctions or material between the antenna and the fuselage of the aircraft, the PIM shield being made of a conductive material having a thickness based on the RF skin-depth.

12. The method of claim 11, wherein the providing comprises providing a PIM material that absorbs undesired RF signals.

13. The method of claim 11, wherein the providing comprises providing a PIM shield being made of a conductive material having a smooth PIM free surface.

14. The method of claim 11, wherein the providing comprises providing a PIM shield being made of a conductive material having a thickness greater than the RF skin-depth.

15. The method of claim 11, wherein the providing comprises providing the PIM shield as an integral part of a structure of the antenna.

16. The method of claim 11, wherein the providing comprises spraying the conductive material at a region between the fuselage and the antenna.

17. The method of claim 11, wherein the providing comprises brushing the conductive material at a region between the fuselage and the antenna.

18. The method of claim 11, wherein the providing comprises providing a thin continuous sheet of conductive material.

19. The method of claim 11, wherein the providing comprises combining at least two layers of different conductive materials together to form the conductive material.

20. The method of claim 11, wherein the providing comprises providing a high loss RF conductive material that absorbs signals.

21. The method of claim 11, wherein the providing comprises providing any of silver, copper, gold, aluminum, brass, bronze, mercury and graphite as the conductive material.

* * * * *